US005587570A

United States Patent [19]

Kelaita, Jr. et al.

[11] Patent Number: 5,587,570

[45] Date of Patent: Dec. 24, 1996

[54] CIRCUIT BREAKER INTERLOCK UNIT TO PREVENT SINGLE PHASING

[75] Inventors: Joseph B. Kelaita, Jr., Bristol; Edwin J. Collin, Southington, both of Conn.

[73] Assignee: General Electric Company, New York, N.Y.

[21] Appl. No.: 272,480

[22] Filed: Jul. 11, 1994

[51] Int. Cl.[6] ..... H01H 9/20

[52] U.S. Cl. ..... 200/50.01; 337/4; 200/50.11

[58] Field of Search ..... 200/172, 18, 50 R–50 C, 200/50.01–50.2; 361/600, 601, 605, 615, 616, 626, 630, 641, 642, 646; 337/4, 6, 7, 41, 42, 43, 44–50, 70, 79

[56] References Cited

U.S. PATENT DOCUMENTS 3,893,052 7/1975 Kotos et al. ..... 335/229
3,909,762 9/1975 Wilks et al. ..... 337/4
4,068,283 1/1978 Russel et al. ..... 361/205
4,079,214 3/1978 Castonguay et al. ..... 200/50 A
4,274,121 6/1981 Howell et al. ..... 361/96
5,168,137 12/1992 Hufnagel et al. ..... 200/50 R

*Primary Examiner*—Cassandra C. Spyrou
*Assistant Examiner*—Michael A. Friedhofer
*Attorney, Agent, or Firm*—Richard A. Menelly; Carl B. Horton

[57] ABSTRACT

A molded case circuit breaker interlock unit connects between a fuse enclosure attached to one end. Upon the occurrence of a short circuit within a protected circuit, the fuse operates to isolate the protected equipment and is conveniently replaced without disassembling the circuit breaker components. The interlock unit prevents resetting the circuit breaker operating mechanism until the fuse is replaced.

2 Claims, 5 Drawing Sheets

CIRCUIT BREAKER INTERLOCK UNIT TO PREVENT SINGLE PHASING

BACKGROUND OF THE INVENTION

U.S. patent application Ser. No. 08/140,928 filed Oct. 25, 1993 entitled "Induction Motor Protective Circuit Breaker Unit" describes the use of a fuse unit connected in series with an electric circuit breaker to protect an electric motor and associated equipment. When any of the fuses are subjected to short-circuit currents, the fuse must be timely replaced. Since a separate fuse is inserted within each phase of a multi-phase electrical distribution system, the blown fuse within an associated phase must be replaced before the circuit breaker is turned on. This is to prevent so-called "single phasing" whereby the current transfers through the remaining phases causing damage to the wiring and associated electrical equipment.

U.S. Pat. Nos. 3,893,052, 4,068,283, and 4,274,121 each describe the use of circuit breakers with "targets" that are associated with the separate phases within a protected circuit to provide visual indication to an operator as to which of the phases has experienced overcurrent circuit interruption.

When such circuit breakers are used within electrical equipment enclosures, and the circuit breakers are turned off and on by remote handle operating devices, the operator may not know that one of the fuses is blown, or that a short circuit condition has occurred.

One purpose of the invention, is to prevent the circuit breaker from being turned on after a fault occurrence until the operator has determined the nature of the fault and that all the phases within the multi-phase system are operational after the fault is cleared.

SUMMARY OF THE INVENTION

The invention concerns a molded case circuit breaker that includes a fuse within each separate phase for short circuit protection. When the fuses are arranged within a unit that is attached to one end of the circuit breaker housing, a slidably mounted plate interlocks the circuit breaker handle or remote handle operator with the blown fuse indicator to insure that the circuit breaker is not turned back on until the fuse is replaced.

DESCRIPTION OF THE PREFERRED EMBODIMENT

Figure 1:
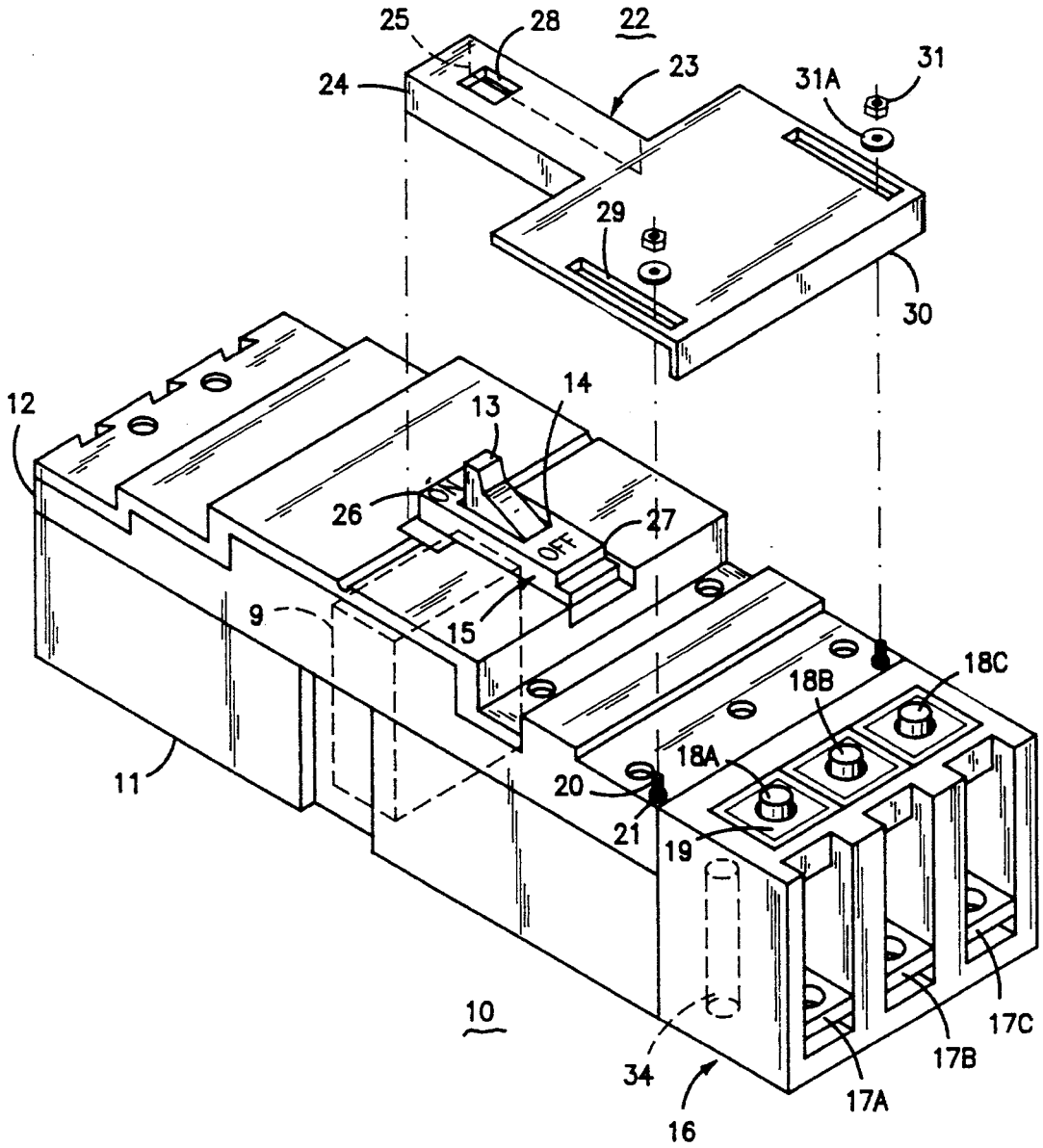
FIG. 1 is a top perspective view of a molded case circuit breaker and fuse unit prior to attaching the fuse interlock unit in accordance with the invention.
Figure 2:
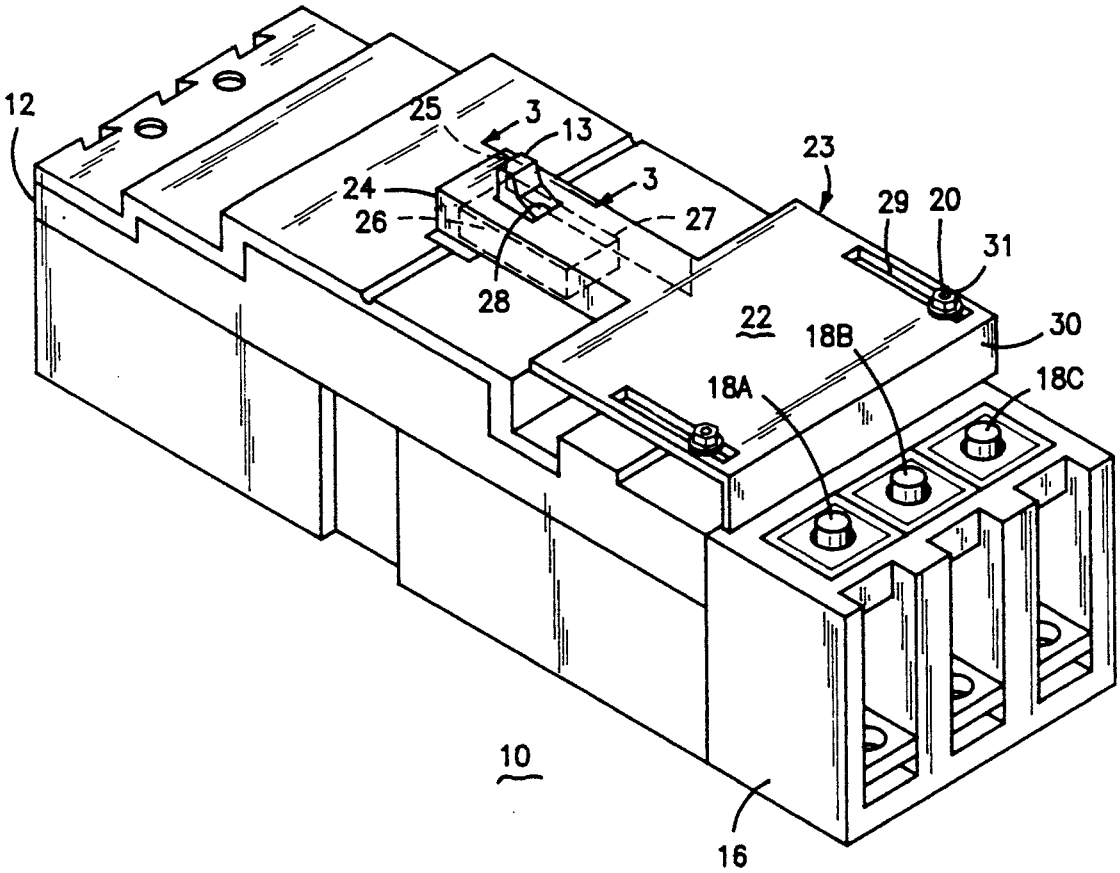
FIG. 2 is a top perspective view of the circuit breaker and fuse unit of FIG. 1 containing the fuse interlock unit.

The circuit breaker 10 described within the aforementioned U.S. patent application 08/140,928 is shown in FIG. 1 prior to attaching the fuse interlock unit 22. The circuit breaker includes a plastic case 11 to which a molded plastic cover 12 is attached. An operating handle 13 extends through a slot 14 in the escutcheon 15 extending from the top surface of the cover. The operating handle interacts with the circuit breaker operating mechanism 9 to reset the operating mechanism after a circuit interruption as well as turning the circuit breaker contacts (not shown) between their ON and OFF conditions. A good description of the circuit breaker operating mechanism is found in U.S. Pat. No. 4,736,174 entitled "Molded Case Circuit Breaker Operating Mechanism." The fuse unit 16 as described within the aforementioned U.S. patent application Ser. No. 08/140,928, contains a fuse 34 within each separate phase compartment 19. Separate indicators 18A, 18B, 18C are associated with the separate fuses which connect with the A–C phases of the electrical distribution system through separate terminal lugs 17A, 17B, 17C. In accordance with the teachings of the invention, a fuse interlock unit 22 is attached to the top of the circuit breaker and the fuse unit by first placing the rectangular slot 28 over the operating handle 13 then capturing the threaded posts 20, arranged within the openings 21 in the fuse unit, within the elongated slots 29 formed within the T-shaped fuse interlock plate 23. The nuts 31 and washers 31A are threaded onto the posts to retain the plate while allowing the plate to slide along the top surface of the circuit breaker. The rails 24, 25 extending from the plate are guided by the sidewalls 26, 27 of the escutcheon 15 while the end tab 30 extending downward from the plate interacts with the indicators 18A, 18B, 18C as best seen by now referring to the circuit breaker 10 shown in FIG. 2.

With the fuse interlock unit 22 attached to the circuit breaker 10 by means of the posts 20 within the slots 29 and nuts 31, the transfer of the plate along the top surface of the circuit breaker is guided by the side rails 24, 25 on the plate 23 and the escutcheon sidewalls 26, 27. The transfer of the plate 22 is controlled by the position of the handle 13 relative to the rectangular slot 28, the position of the indicators 18A, 18B, 18C to the top surface of the fuse unit 16 and the location of the tab 30 on the end of the plate 23 as described below with reference to FIGS. 4 and 5.

Figure 3:
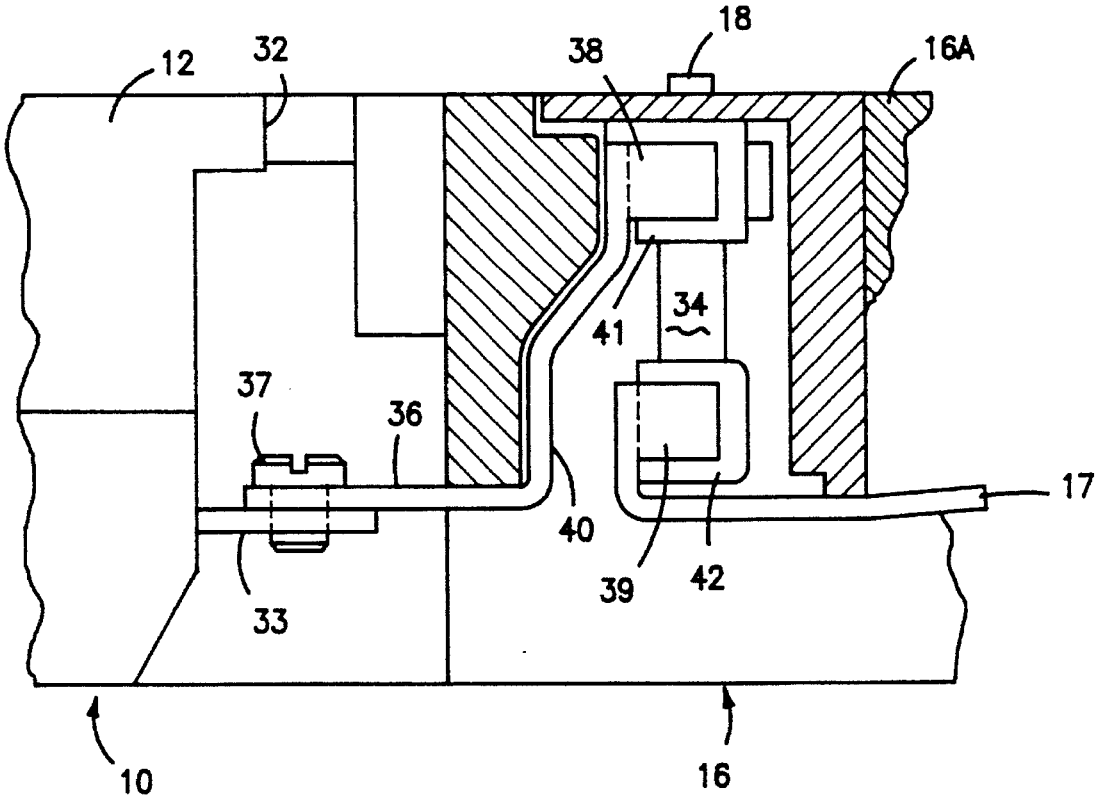
FIG. 3 is an enlarged side view of the circuit breaker, fuse unit and fuse interlock unit of FIG. 2 in partial section.

The arrangement of the fuse 34 within one compartment of the fuse unit 16 is shown in FIG. 3 with the fuse unit attached to the circuit breaker 10 by means of the connector strap 36, circuit breaker terminal strap 33 and terminal screw 37. Access to the terminal screw is made by means of the opening 32 within the circuit breaker cover 12. The central part 40 of the connector strap 36 extends within the fuse unit 16 and terminates in a fuse clip 38 for retaining one electrode 41 of the fuse 34. The electrode 42 at the other end of the fuse connects with the fuse clip 39 formed at the end of the fuse clip terminal strap generally indicated at 17. The fuse 34 is a self indicating fuse such as that described within U.S. Pat. No. 5,319,344 with the indicator, shown generally at 18, extending only slightly above the top 16A of the fuse unit 16. In place of the fuse within the fuse unit, a standard indicating target such as described within the aforementioned U.S. Pat. No. 3,893,052, could be contained within the phase compartments to signal an overload occurrence in any of the individual phases, as described earlier.

Figure 4:
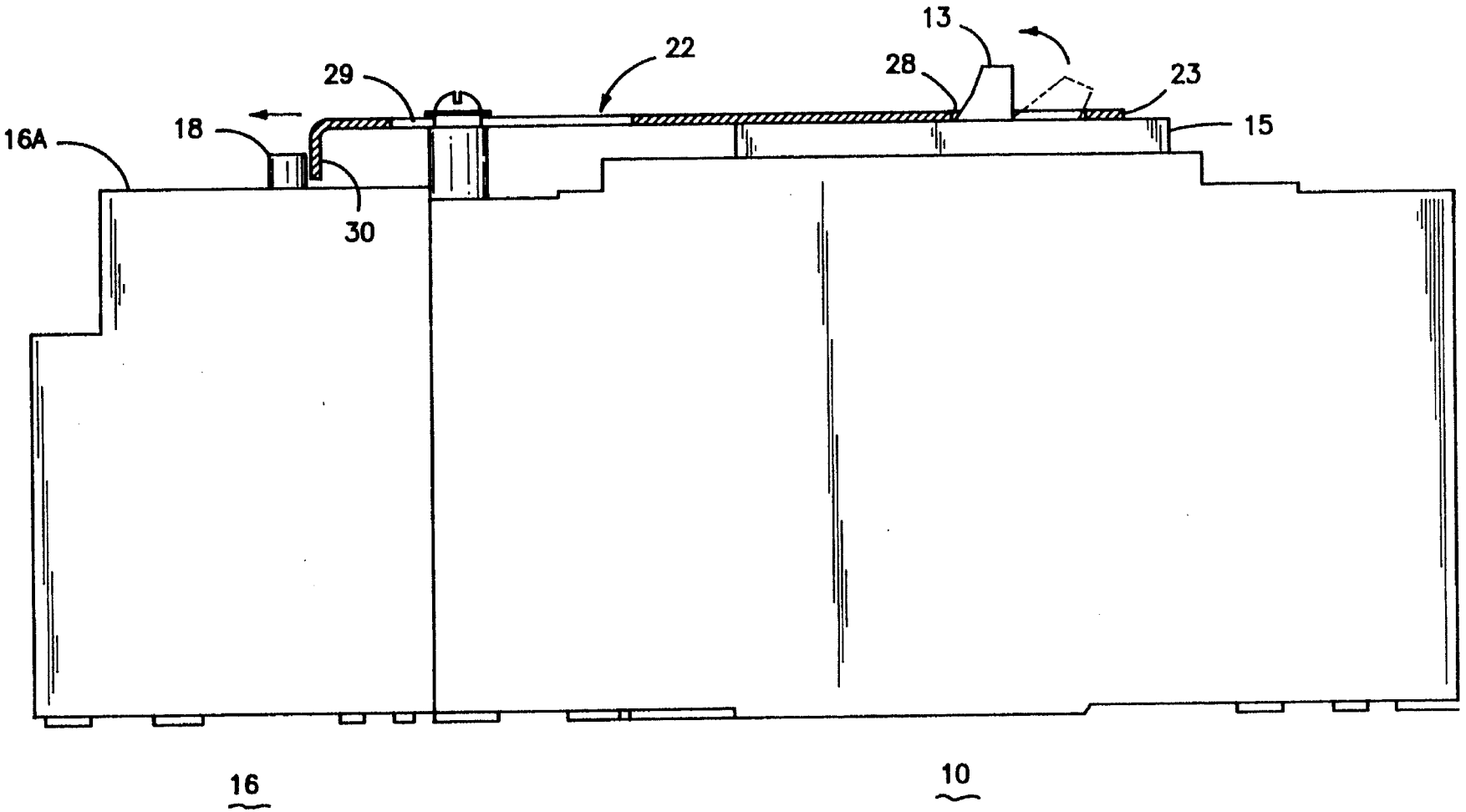
FIG. 4 is an enlarged side view of the circuit breaker, fuse unit and fuse interlock unit of FIG. 2 with the circuit breaker operating handle in the tripped position.
Figure 5:
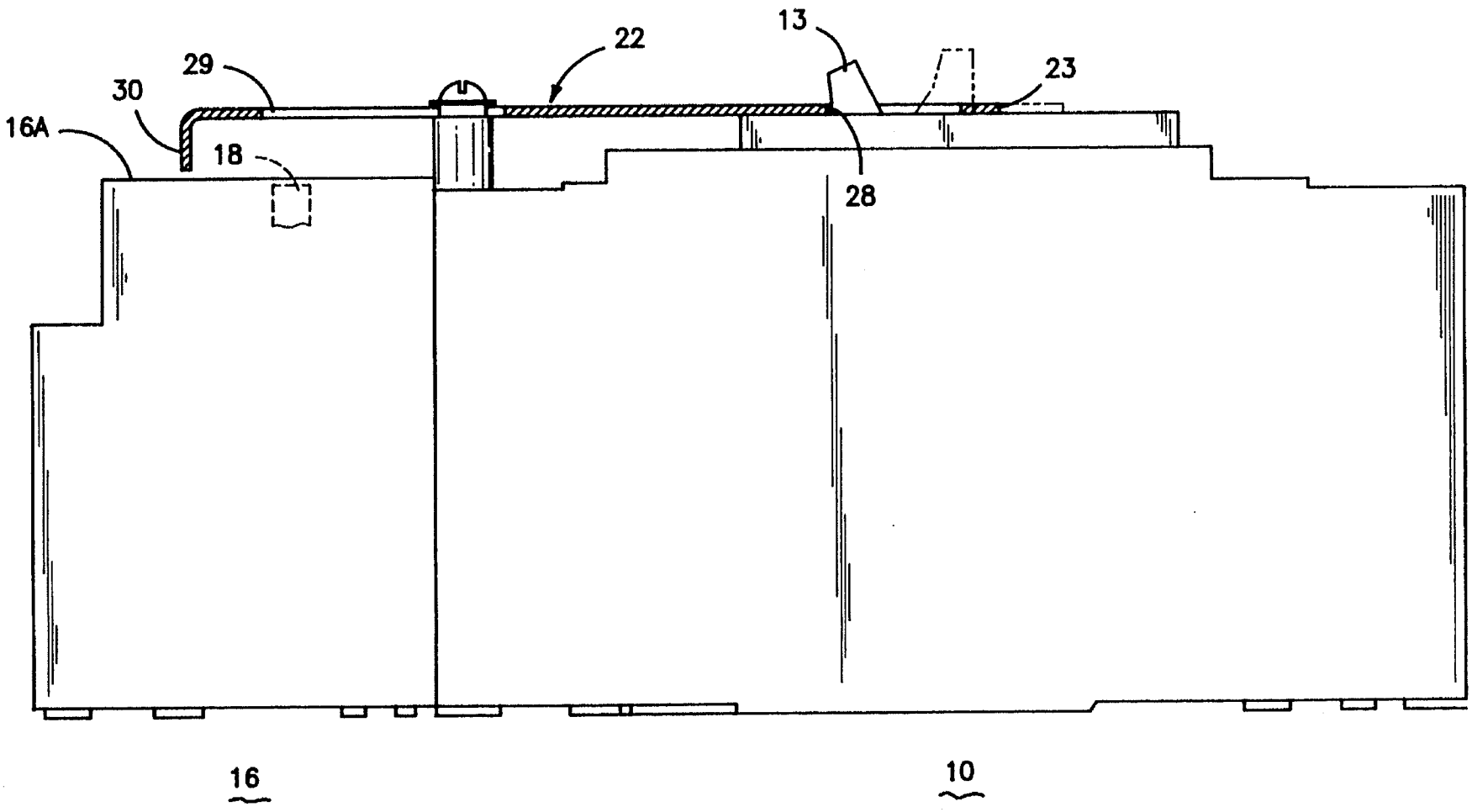
FIG. 5 is an enlarged side view of the circuit breaker, fuse unit and fuse interlock unit of FIG. 2 with the circuit breaker operating handle in the reset position.

Upon the occurrence of an overcurrent condition, as depicted with the circuit breaker 10, fuse unit 16 and fuse interlock unit 22 in FIG. 4, the operating handle moves from the ON position, as shown in phantom, to the TRIPPED position shown in solid lines within the rectangular slot 28 of the plate 23. The indicator 18 moves in the indicated vertical direction above the top 16A of the fuse unit. When an attempt is made to move the operating handle to the RESET position of FIG. 5, the tab 30 at the end of the plate is driven by contact between the operating handle and the end of the rectangular slot 28 into contact against the upstanding indicator 18 and is prevented from further travel along the top of the escutcheon 15 in the indicated direction. The interference between the tab 30 and the indicator thereby prevents the operating handle from being moved to the RESET position to turn the circuit breaker on.

When the fuse is replaced, or the target is reset, the indicator 18 moves back to the home position just above the top 16A of the fuse unit 16 to allow the movement of the operating handle 16 from the TRIPPED position in phantom to the RESET position in solid lines against the edge of the rectangular slot 28 driving the tab 30 at the end of the plate 23 over the top of the indicator to move the operating handle 16 back to the ON position shown in FIG. 4.

A handle interlock arrangement has been described for use with circuit breakers when fuses and or targets provide indication of an interruption in one phase of a multi-phase electrical distribution system. A slide plate interferes with the transfer of the circuit breaker handle to prevent resetting the circuit breaker operating mechanism and circuit breaker contacts until the fuse is replaced or the target is reset.

We claim:

1. A molded case circuit breaker handle interlock arrangement comprising:

a molded plastic case 10 and cover 12;

operating means 9 within said case for moving a pair of contacts to an open condition to interrupt circuit current upon the occurrence of an overcurrent condition within a protected electric circuit;

an indicator 18 extending through said cover and moving to an extended position providing indication of said overcurrent occurrence;

an operating handle 13 extending through said cover providing manual access for controlling said operating means and returning said contacts to a closed condition; and interlock means 22 interacting between said operating handle and said indicator for preventing said contacts from moving to said closed condition until said indicator is returned from said extended position.

2. The molded case circuit breaker handle interlock arrangement of claim 1 wherein said interlock means comprises a shaped plate 23 arranged on a top surface of said cover and having a handle slot 28 at one end, said operating handle being received within said handle slot.

* * * * *